United States Patent [19]

Thomas

[11] 4,227,742

[45] Oct. 14, 1980

[54] MULTI-POSITION, RETRACTABLE LEG REST FOR A WHEELCHAIR

[75] Inventor: Morton I. Thomas, Nyack, N.Y.

[73] Assignee: Temco Products, Inc., Passaic, N.J.

[21] Appl. No.: 7,678

[22] Filed: Jan. 30, 1979

[51] Int. Cl.[2] ..... A47C 7/50

[52] U.S. Cl. ..... 297/430; 297/DIG. 4

[58] Field of Search ..... 248/394, 396; 280/242 WC; 297/150, 153, 429–437, DIG. 4

[56] References Cited

U.S. PATENT DOCUMENTS

| | | | |
|---|---|---|---|
| 2,633,896 | 4/1953 | Thompson | 297/433 X |
| 3,672,722 | 6/1972 | Murcott | 297/437 |
| 3,902,758 | 9/1975 | Pivacek | 297/430 |

OTHER PUBLICATIONS

Edco–Recliner Chair/Table Model No. 4665/1 with optional No. 4670/1–self–storing leg rest.

Edco–Self–Storing Leg Rest–Model 4670.

Bio–Care Seating Systems from Edco.

p. 68, Surgical Business/Sep. 1978, describing a patient's chair, manufactured by Steelcraft, Inc.

*Primary Examiner*—James C. Mitchell

*Attorney, Agent, or Firm*—Richard C. Woodbridge

[57] ABSTRACT

A wheelchair includes an improved, retractable multi-position leg rest apparatus. The leg rest is attached to the frame of the footrest of the wheelchair in a conventional manner. The leg rest cushion is carried on a frame which slidably engages the footrest frame. A rotatable U-shaped transverse member comprises part of the leg rest frame and is adapted to selectively engage a hook on the underside of the leg rest cushion to lock the rear end of the cushion in an elevated position. The rear of the leg rest cushion can be lowered by disengaging the tubular member from the hook. A T-shaped member also comprises part of the leg rest frame and is connected to the front edge of the underside of the cushion. The T-shaped member includes a pair of telescoping elements which house a spring-loaded pushbutton and a spring urged stop mechanism for locking the front edge of the leg cushion in at least three separate vertical positions. Undesirable horizontal forces exerted on the cushion and on the T-shaped member are minimized by a pair of stop means attached to the transverse U-shaped rotatable element. The present invention is especially useful because it can be easily manipulated by one person and may be horizontally and vertically adjusted to a wide variety of comfortable positions.

8 Claims, 16 Drawing Figures

Fig. 5.
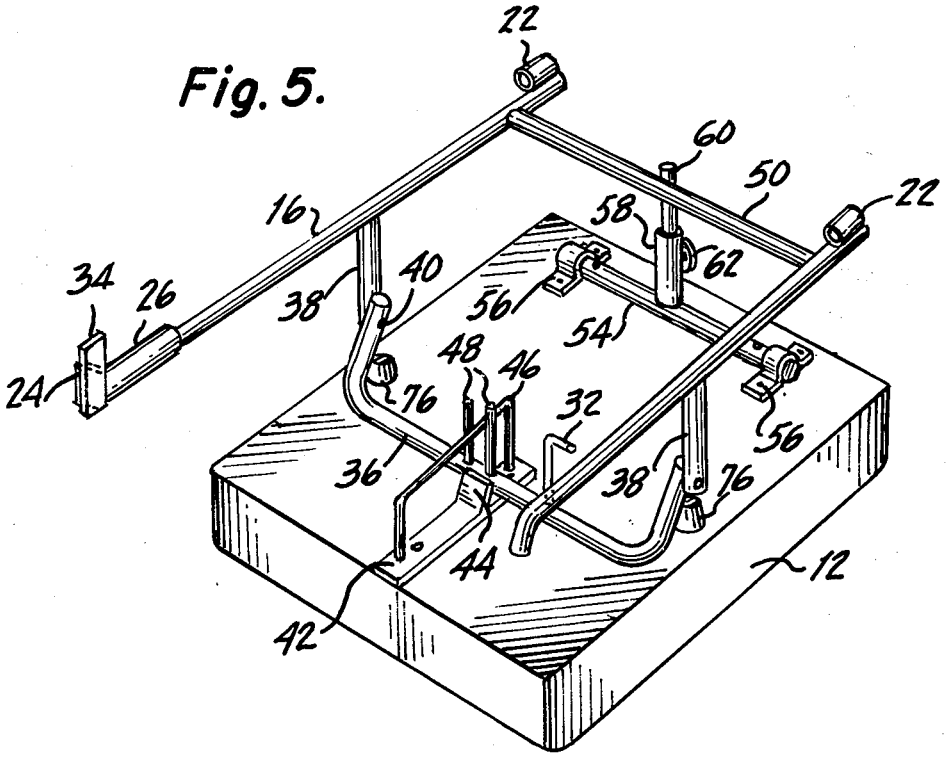
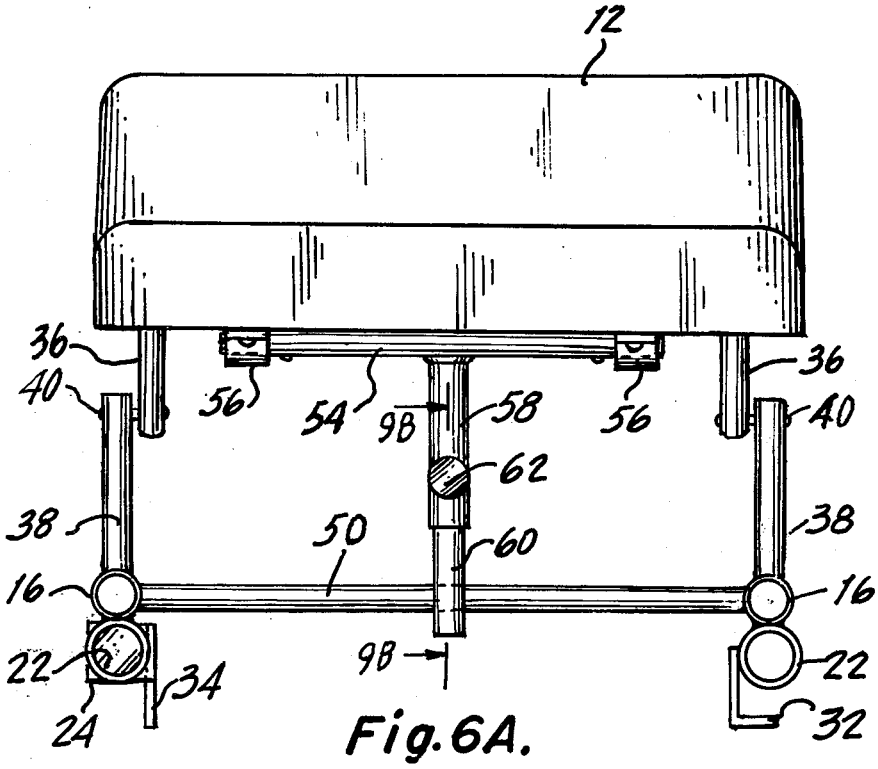
Fig. 6A.

Fig. 6B.
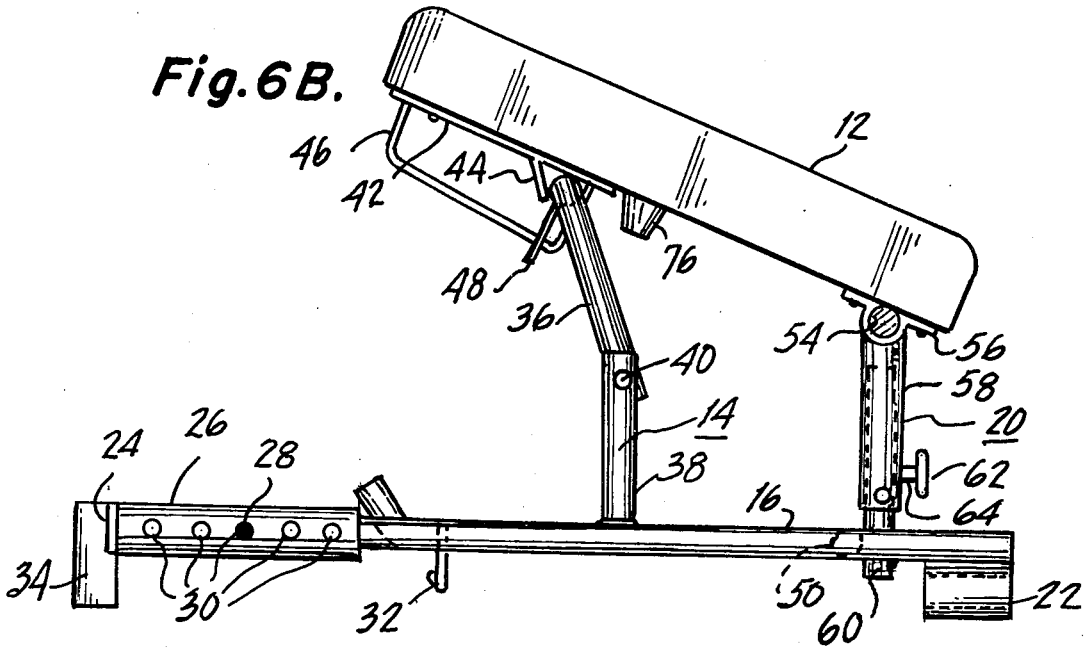
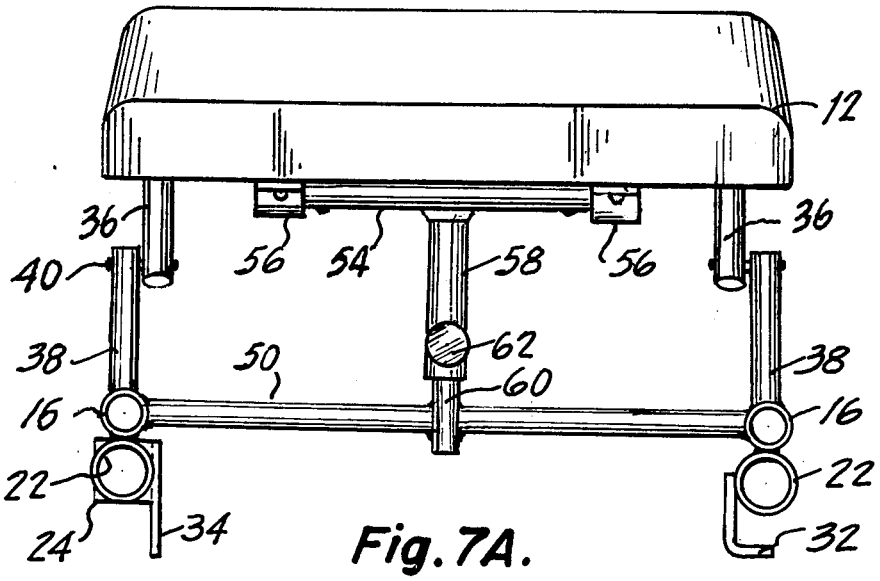
Fig. 7A.

Fig. 7B.
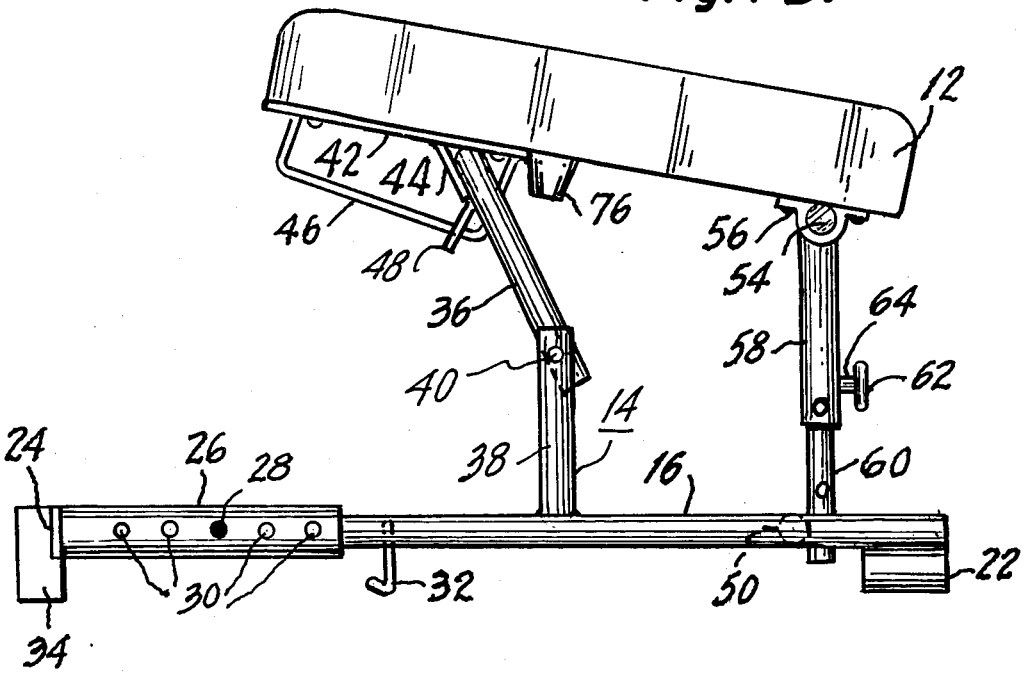
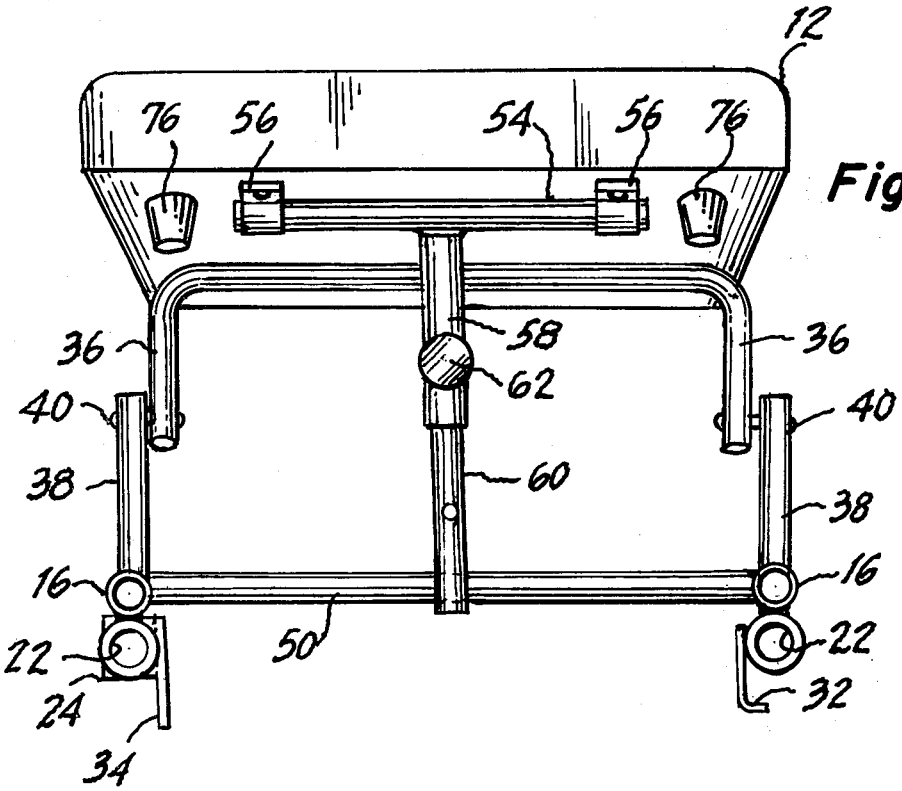
Fig. 8A.

Fig.8B.
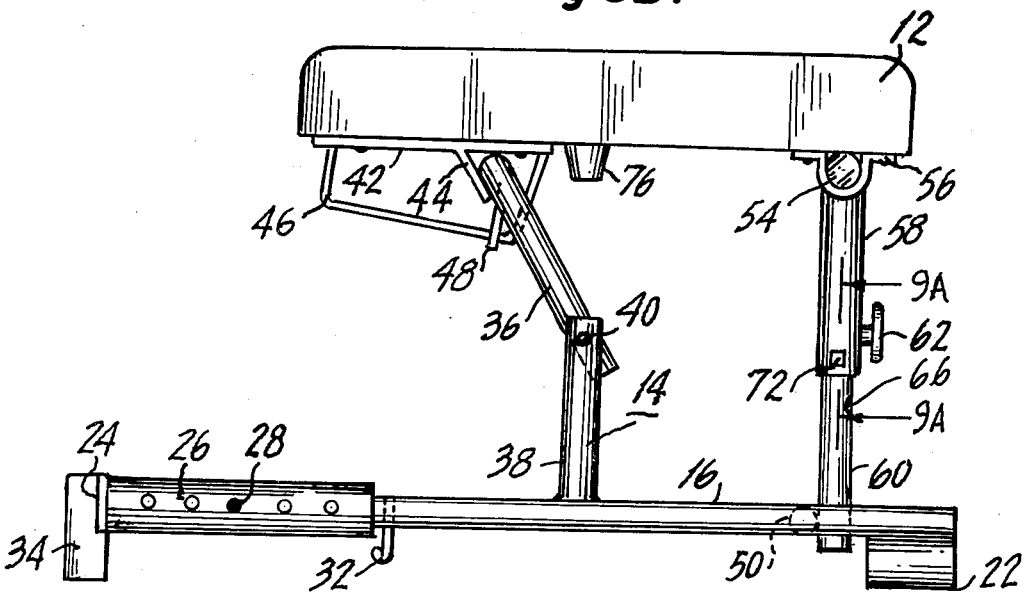
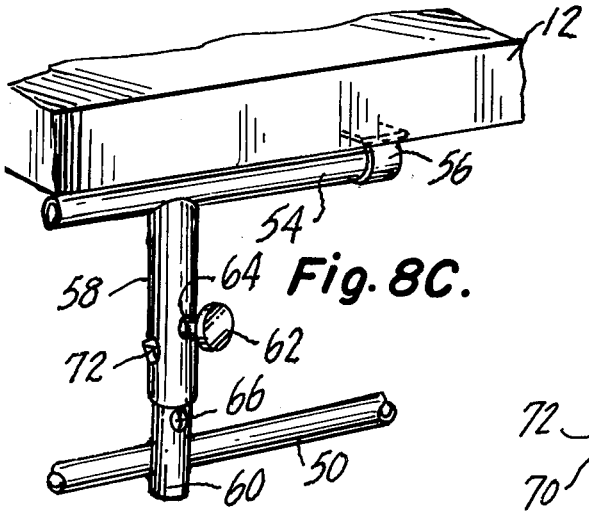
Fig. 8C.
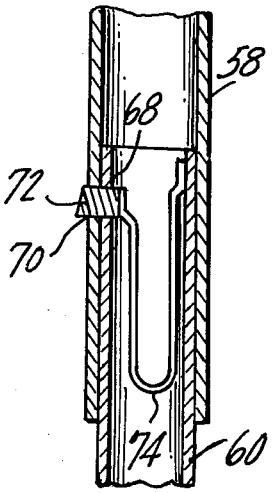
Fig.9A.
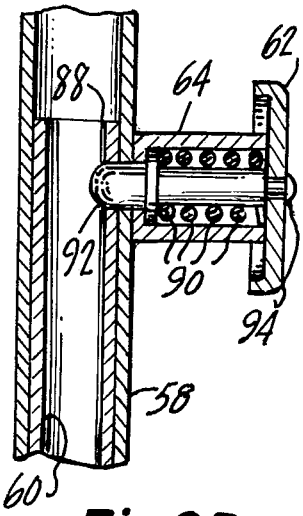
Fig.9B.
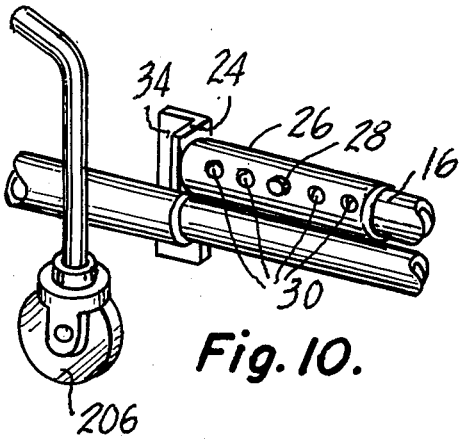
Fig. 10.

MULTI-POSITION, RETRACTABLE LEG REST FOR A WHEELCHAIR

BACKGROUND OF THE INVENTION

1. Field of the Invention

This invention relates to an improved multi-position leg rest of the type used on wheelchairs such as found in hospitals, nursing homes and other institutions, as well as in private homes.

2. Brief Description of the Prior Art

The present invention comprises an improvement over earlier self-storing leg rests such as the Model No. 4670/1 manufactured by Edco, Inc., 125 South Street, Passaic, N.J. 07055. That type of prior art leg rest is often sold as an optional item for standard wheelchairs such as the Edco Model 4665/1 recliner chair/table, the Edco mark II EASYRIDER wheelchair, Model No. 11005 or the Edco BIO-CARE seating system wheelchair.

A similar retractable leg rest is manufactured by Steelcraft, Inc., Millbury, Mass. 01527 and described in the September 1978 edition of Surgical Business Magazine.

U.S. Pat. No. 3,902,758 issued on Sept. 7, 1975 to William J. Pivacek discloses a "Self-Storing Foot and Legrest Assembly". That disclosure is relevant in that it shows a simple retractable leg rest for a wheelchair, however, it is quite different in structure and adjustability.

Prior art leg rests such as those just described have the following structural and functional disadvantages. Firstly, they often have a limited range of vertical and horizontal cushion positions. Secondly, they may be difficult for one individual to adjust. Thirdly, they may consume more time and material in the manufacturing phase. Fourthly, they do not include specific means to guard against horizontal instability. It was in the context of the foregoing problems that the present invention arose.

SUMMARY OF THE INVENTION

Briefly described the invention comprises an improved multi-position, retractable leg rest for use with a conventional type wheelchair.

A conventional leg rest cushion is attached to a leg rest frame which is adapted to slide over the telescoping footrest frame of a wheelchair. A rotatable, transverse U-shaped member spans the frame and is adapted to selectively engage a hook in a plate attached to the rear bottom edge of the cushion. A rigid wire guard is attached to the plate at two locations and surrounds the rotatable transverse member. The guard prevents the transverse member from escaping from the vicinity of the hook. The rear edge of the cushion is elevated by manually engaging the transverse member in the rear hook. Conversely, the rear edge of the cushion is lowered for storage be disengaging the transverse member from the hook.

The front of the leg rest frame includes a rigid transverse member. A T-shaped element has its base welded to the transverse member. The arms of the T member comprise a tubular element which is attached to the front underside of the cushion by a pair of brackets which allow the tubular element to rotate. A second tubular element is connected perpendicularly to the first tubular element and is adapted to telescopically receive a third tubular element welded to the center of the transverse element. When the third tubular element is fully telescoped into the second tubular element, the front edge of the leg cushion is in its first, lowest position. The leg rest apparatus may be stored under the cushion of the wheelchair if the front and rear edges of the leg rest cushion are in their lowest position. As the third tubular element is withdrawn from the second tubular element a spring-loaded pushbutton will lock the second and third element in an intermediate, second position. If the pushbutton is released and the third tubular element further withdrawn from the second tubular element, the bracket will automatically lock in its highest or third position. In the third position the legrest is essentially horizontal to the plane of the wheelchair seat.

These and other features of the invention are more fully described in the drawings and the detailed description of the invention that follows.

BRIEF DESCRIPTION OF THE DRAWINGS

FIG. 5 is a perspective view of an inverted leg rest showing the rear edge in the elevated mode.

FIG. 6A is a front elevational view of the leg rest showing the front edge in the lowest, first position and the rear edge in the elevated mode.

FIG. 6B is a side elevational view of the cushion seen in FIG. 6A.

FIG. 7A is a front elevational view of the leg rest with the front edge in the intermediate, second position and the rear edge in the elevated position.

FIG. 7B is a side elevational view of the leg rest shown in FIG. 7A.

FIG. 8A is a perspective front elevational view of the leg rest with the front edge in the highest, third position and the rear edge in the elevated mode.

FIG. 8B is a side elevational view of the leg rest seen in FIG. 8A.

FIG. 8C is a detailed perspective view of the telescoping T-shaped locking mechanism shown in the third position.

FIGS. 9A–9B are cross-sectional views of the locking mechanism in the third position.

FIG. 10 is a detail perspective view of the horizontal adjustment mechanism.

DETAILED DESCRIPTION OF THE INVENTION

During the course of this description like numbers will be used to indicate like elements according to the different figures which illustrate the invention.

Figure 1:
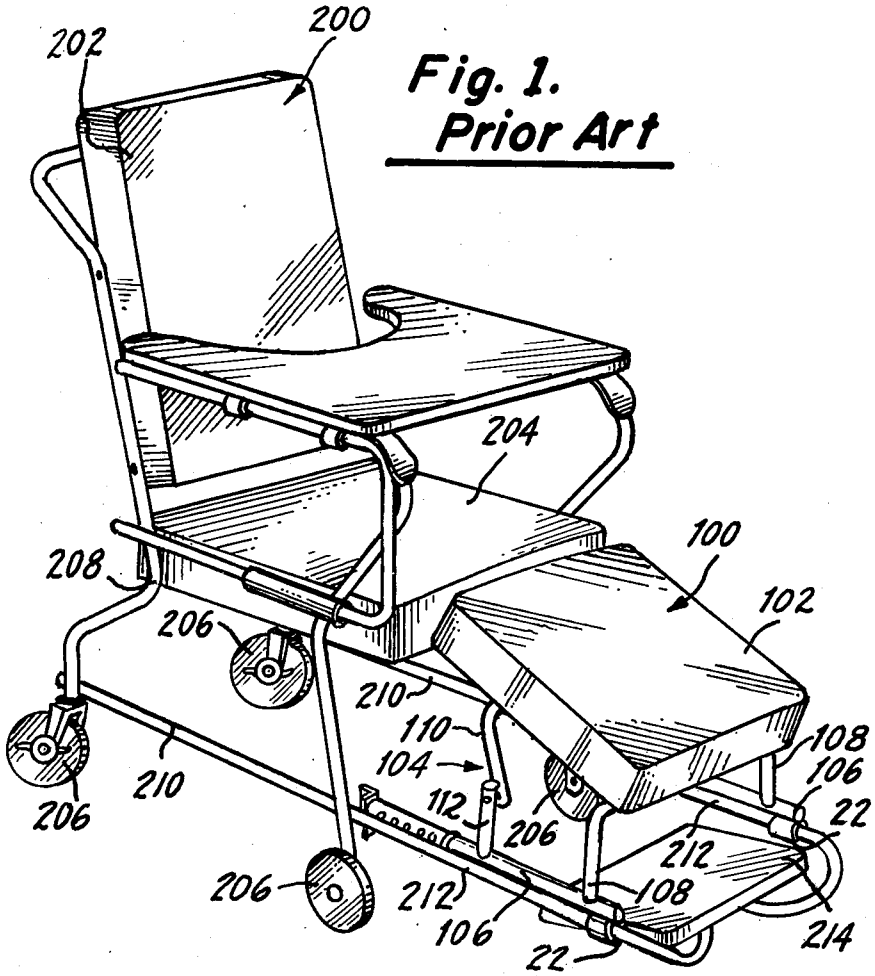
Fig. 1. Prior Art
FIG. 1 is a perspective view of a prior art leg rest shown in the operative position on a conventional wheelchair.

A prior art leg rest is illustrated in perspective view in FIG. 1. The leg rest corresponds to the Edco Model 4670 which is adapted to fit all Edco series 4600, 4700 and 4800 series chair/tables. The leg rest slidably engages the telescoping footrest of a prior art wheelchair so that it can be extended for use or retracted under the seat of the wheelchair for storage. A comprehensive description of this prior art leg rest is provided in the Edco specification sheet entitled "Self-Storing Leg Rest"—"An Elevated Leg Rest Which Provides Extra Comfort with Edco Chair/Tables" which is incorporated herein by reference.

A typical prior art wheelchair 200 essentially comprises a backrest 202, a seat 204, a plurality of wheels 206 and a frame 208 which connects element 202, 204 and 206 together. A set of tubular elements 210 are adapted to telescopically receive tubular elements 212 which are connected to footrest 214.

The prior art leg rest 100 comprises a cushion 102 and a leg rest frame 104. Frame 104 includes a pair of tubular members 106 which are slidably engaged with chair elements 210 and 212. A first rigidly mounted U-shaped element 108 is connected to the underside of the front edge of cushion 102 in such a manner that the cushion 102 can rotate about the U-shaped element 108. A second U-shaped bracket 110 is pivotally connected to a pair of upright braces 112 which are welded to tubular elements 106. U-shaped bracket 110 may be selectively engaged in a hook in a plate connected to the underside of the rear edge of cushion 102.

The prior art leg rest 100 essentially differs in structure from the leg rest 10 of the present invention in two important ways. Firstly, rigid bracket 108 has been completely replaced by a more sophisticated mechanism which allows the front edge of the leg cushion to be selectively positioned at three different elevations. Secondly, the rear of the cushion 102 includes a stop means to improve the horizontal stability of the apparatus. These and other features of the improved leg rest apparatus can be more fully understood with reference to FIGS. 2 through 10.

Figure 2:
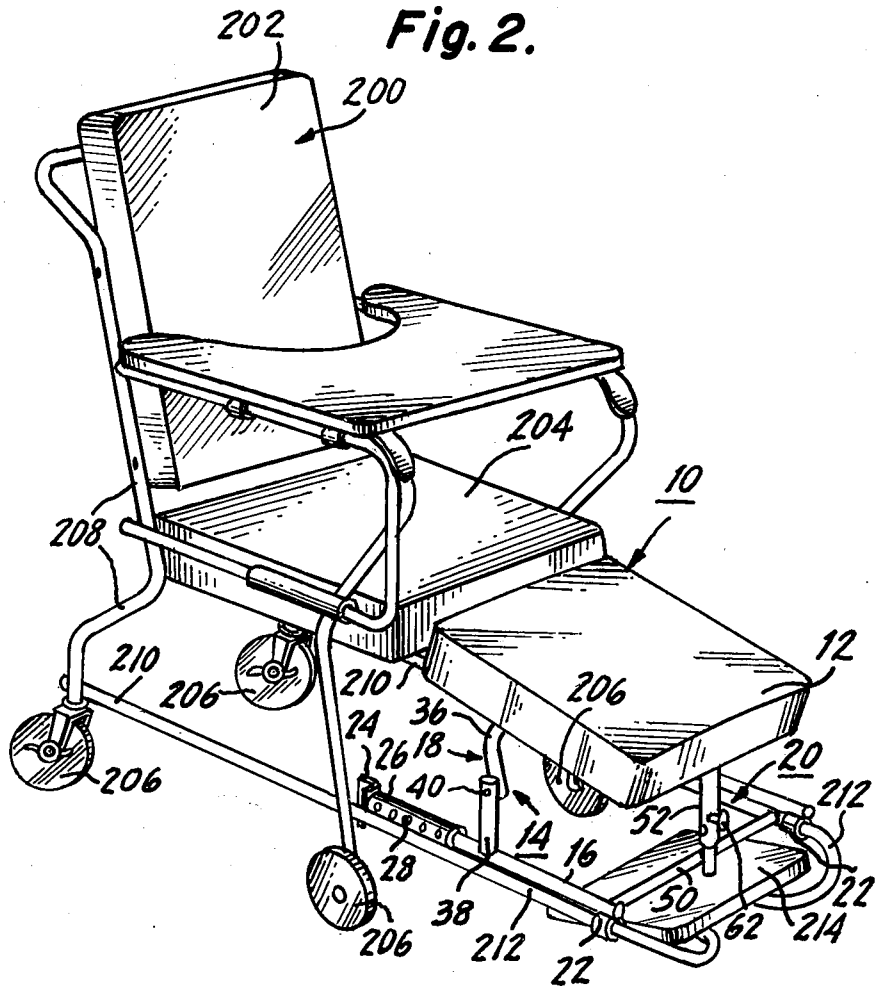
FIG. 2 is a perspective view of the leg rest of the present invention shown in the operative mode.

The leg rest 10 according to the preferred embodiment of the present invention is illustrated in its operative position in FIG. 2. The leg rest 10 primarily comprises cushion 12 and leg rest frame 14 which connects the cushion 12 to the footrest frame 210 and 212 of the conventional prior art wheelchair 200. The leg rest frame 14 comprises a pair of tubular elements 16, a rear height adjustment mechanism 18 and a front height adjustment mechanism 20. Two rubber feet 76 are attached to opposite sides of cushion 12. A pair of tubular bearings 22 are connected to tubular elements 16 and slidably engage the extended tubular elements 212 of the prior art footrest frame. A stop element 24 is connected to one of the tubular elements 16 and is adapted to selectively engage the forward leg of the prior art wheelchair frame 208 so as to secure the leg rest in its most forward position. There is sufficient clearance between bearings 22 and tubular element 212 to enable stop element 24 to swing upwardly in order to disengage it from the forward edge of the side frame 208. Stop element 24 is attached to telescoping horizontal adjustment tube 26 which surrounds and receives tubular element 16. A pushbutton mechanism 28 is housed within tubular element 16 and 26. By manually depressing pushbutton 28 and selectively locating it in any one of a plurality of adjustment holes 30 it is possible to locate the leg rest apparatus at any one of five different horizontal positions. See FIG. 3B.

The other tubular element 16 carries with it a tab 32 which makes continuous contact with telescoping elements 210 and 212. The purpose of tab 32 is to guide the rear portion of the leg rest apparatus. Stop element 24 also includes a downwardly depending tab section 34 which serves the same function on the other side of the apparatus from tab 32. In FIG. 2 the stop element 24 is shown at rest against one of the side frames 208. It is clear that stop element 24 functions both as a stop member and as a bearing adapted to guide tubular elements 16 and 26 on tubular elements 210 and 212 of the wheelchair.

The rear height adjustment mechanism 18 includes a first transverse U-shaped frame member 36 which is pivotally connected at opposite ends thereof to studs 38 which in turn are welded to intermediate sections of tubular element 16. Rivets 40 pass through studs 38 and frame member 36 in such a way as to allow member 36 to rotate upwardly and downwardly.

A plate 42 is attached to the rear underside of cushion 12. Hook element 44 is attached to plate 42 and depends downardly therefrom at an angle of about 60° from the horizontal. A rigid wire frame 46 is connected to the front and back ends of plate 42 and forms a guard surrounding transverse frame member 36. Transverse frame member 36 carries with it a pair of downwardly depending ¼" rod elements 48 which bracket wire frame 46. The purpose of rod elements 48 is to limit undesirable sideways motion of the cushion 10.

Figure 3B:
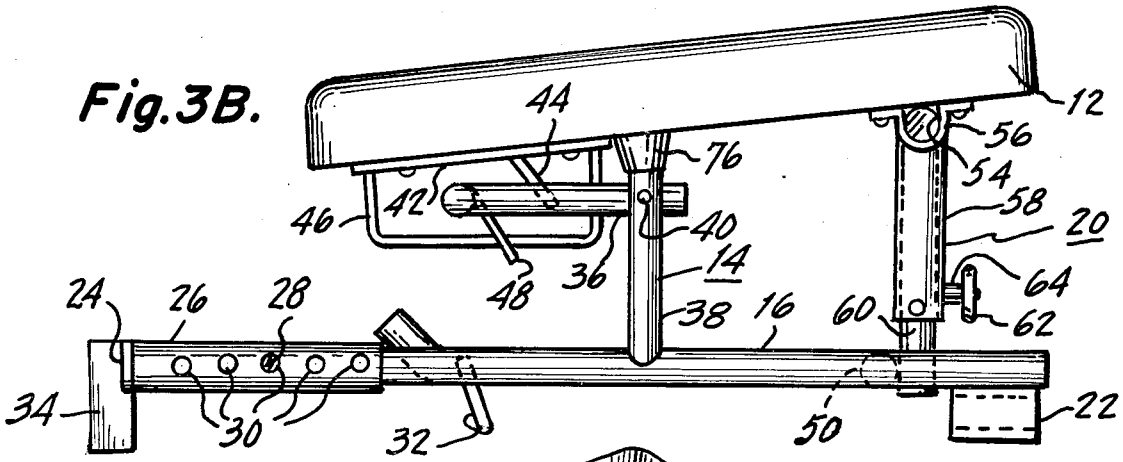
FIG. 3B is a detailed side elevational view of the leg rest in the storable position.
Figure 4:
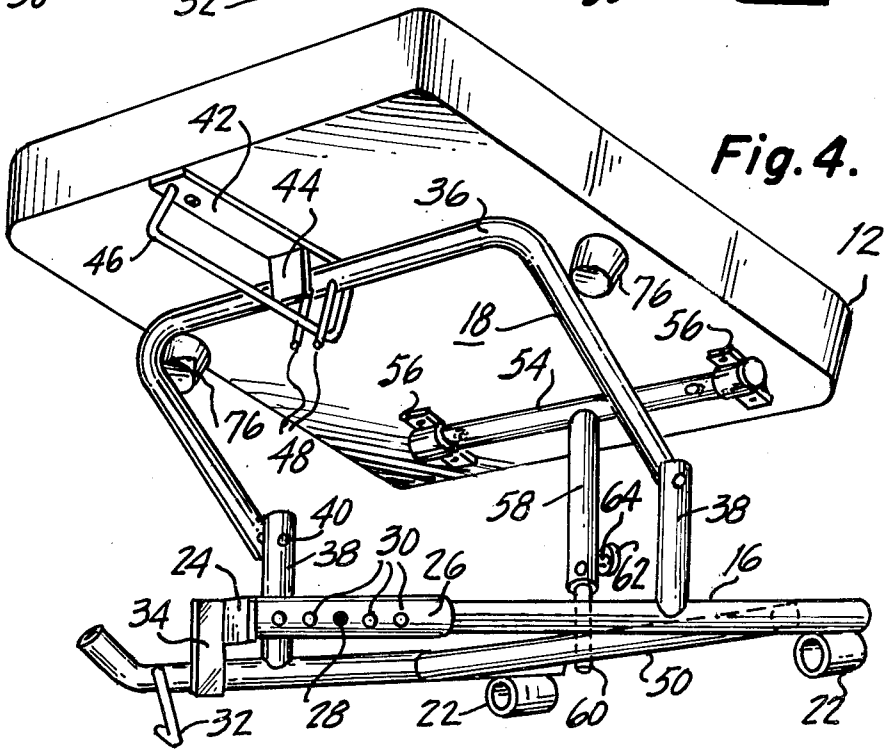
FIG. 4 is a perspective view of the leg rest from underneath showing the rear edge thereof in the elevated mode.
Figure 3A:
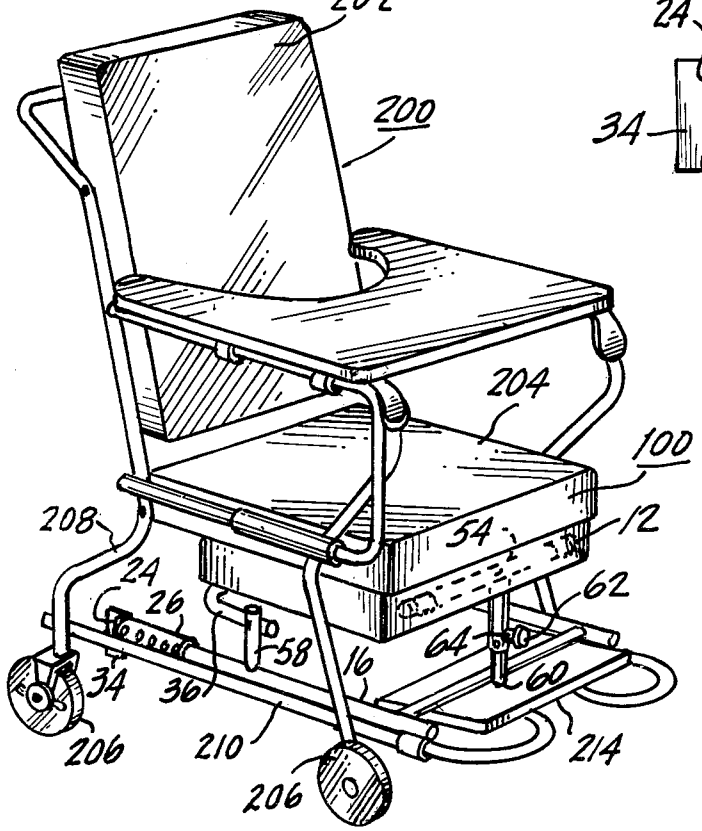
FIG. 3A is a perspective view of the leg rest of the present invention as shown in the retracted or stored mode.

The rear edge of the cushion 12 is secured in its elevated operative position by engaging transverse frame member 36 in hook 44 as shown in FIG. 4. When it is desired to lower the rear edge of the cushion, the transverse frame member 36 is disengaged from hook 44 and the cushion 12 is allowed to swing down from the position shown in FIG. 4 to the position illustrated in FIGS. 3A and 3B. The lowering is therefore accomplished by raising the leg rest cushion 12 until the transverse frame member 36 disengages hook 44 thereby causing the transverse frame member 36 to drop onto wire frame 46. The leg rest may then be swung down to its lowest position and moved to the retracted inoperative position under the seat as shown in FIGS. 3A and 3B. In general the leg rest 10 can only be moved to the retracted position when the front edge of the leg rest is in its lowest, or first position, as will be more fully described below.

The front height adjustment mechanism 20 includes a non-rotatable transverse member 50 which spans tubular elements 16 and which supports the base of a T-shaped extendable slide mechanism 52. Details of the T-shaped slide mechanism 52 are illustrated in FIGS. 4, 5, 8C and 9A–9B. As seen in FIG. 5, the arms of the T-shaped mechanism 52 comprise a tubular element 54 which is rotatably attached to the underside of cushion 12 by a pair of brackets 56 located at opposite ends of the arms. The brackets 56 act like trunions which allow the arms 54 to rotate as the edge of cushion 12 is elevated and lowered. The trunk or body of the T-shaped slide mechanism 52 comprises a second tubular element 58 and a third tubular element 60 which telescopes into the second tubular element 58. The second tubular element 58 is welded transversely to the center portion of the first tubular element 54. Similarly, the third tubular element 60 is welded to transverse member 50 and is perpendicular thereto. Second tubular element 58 carries with it a conventional spring-loaded pushbutton mechanism 62. The pushbutton mechanism 62 has a fairly broad head so that it can be easily manipulated with the fingers of one hand. A spring is housed within sleeve 64 in such a way as to urge the pushbutton inwardly against the third tubular element 60. Third tubular element 60 includes therein an aperture 66 adapted to engage the plunger associated with the spring-loaded pushbutton mechanism 62. When the plunger is received in aperture 66 the front height adjustment mechanism is in its intermediate, second position or mode.

The third tubular element 60 also includes a second aperture 68 therein which is adapted to line up across from aperture 70 in the second tubular element when the front edge of the cushion 60 is in its highest or third position mode. In that position a straight edged stop button 72 will pop out of hole 68 and into hole 70 to firmly secure the second and third tubular elements with respect to each other. Stop button 72 is continually urged outward by leaf spring 74 housed within the third tubular element 60. This arrangement can be clearly understood by referring to the cross-sectional view of the apparatus in FIG. 9A. The stop button 72 complements pushbutton 62 which also locks in hole 82 in the third position. See FIG. 9B. Accordingly, stop button 72 acts as a safety double lock.

The leg rest 10 is moved into its operative position from its retracted position by the following steps.

Firstly, the footrest 214 is drawn outwardly thereby telescoping tubular members 212 out of tubular elements 210.

Secondly, the leg rest 10 is drawn outwardly along elements 210 and 212 and positioned so that stop element 24 abuts the left front edge of the wheelchair frame 208.

Thirdly, the rear of the cushion 12 is lifted upwardly so that rotatable transverse member 36 can engage hook 44. The third step brings the rear of the cushion to its maximum elevated position.

Fourthly, the front edge of the cushion 10 is vertically positioned to the location of maximum comfort. In this there are three choices. The first position corresponds to the mode illustrated in FIGS. 6A and 6B. In that mode the third tubular element 60 bottoms within the second tubular element 58. This corresponds to the most collapsed state of the front height adjustment mechanism 20 in which neither the pushbutton mechanism 62 nor the stop button 72 are engaged in their respective receiving apertures. For some patients the inclination of the cushion 12 is too steep and accordingly, they may wish to choose the intermediate or second position which is illustrated in FIG. 7A and 7B wherein the angle of the cushion is considerably less acute. In that mode the spring-loaded pushbutton mechanism 62 engages aperture 66 and effectively locks the cushion in the second position. There are circumstances, such as for patients with broken legs, where it is desirable to have the leg cushion on a plane that is substantially horizontal with the seat 204 of the wheelchair 200. This corresponds to the horizontal or third position in which the T-shaped slide mechanism 52 is in its most extended state and the stop button 72 is securely engaged in aperture 70 and the pushbutton mechanism 62 engages hole 82 as shown in detail in FIGS. 8C and 9A–9B. In the third mode the plane of the cushion 12 is also substantially horizontal with the plane of tubular elements 16 as shown in FIGS. 8A and 8B.

Fifthly, for maximum comfort, the leg rest apparatus 10 may be positioned forwardly or rearwardly by telescoping horizontal adjustment mechanism 26. Details of mechanism 26 comprise part of the prior art mechanism and are illustrated in perspective view in FIG. 10. The leg rest apparatus can be positioned forwardly or backwardly into any one of five discrete positions by selectively locating pushbutton 28 in the appropriate adjustment hole 30. Adjustment holes 30 are approximately 1" apart.

The present invention was inspired in large part by complaints from users of prior art wheelchairs. It was found that patients with circulatory problems were not satisfied by the limited range of adjustment offered by prior art leg rests. It was therefore learned that the angle and location of the leg rest with respect to the wheelchair was critical and that the optimum adjustment varied from patient to patient. Accordingly, a need was recognized for an improved leg rest with a greater range of adjustment choices. However, as a practical matter, the adjustment mechanism had to be simple, easy to use, economical to manufacture, cleanable and sturdy. It had to be erectable by one individual with a minimum of difficulty. Moreover, it had to provide not only firm vertical support, but also had to minimize horizontal movement. It was found that the T-shaped mechanism 62 works especially well well for the purpose of elevating the front edge of the cushion 10. However, it had the drawback of being weaker and more vulnerable to torsional moments along the axis of the second and third tubular elements 58 and 60. Accordingly, stop members 48 were added to the transverse rotatable U-shaped member 36 in order to limit undesirable sideways motion of cushion 12 and to minimize the torsional stresses placed upon the T-shaped slide mechanism 52.

The horizontal telescoping adjustment mechanism 26 has been illustrated with five locking holes therein. It would be well within the skill of one with ordinary skill in the art to use more or less than five as the situation required. The exposed tubular portions of the leg rest frames 14 are preferably made of chrome plated steel. However, other appropriate materials could be used just as well. The cushion 12 comprises foam covered with heavy duty Naugahyde®. However, other materials would be well within the skill of those of ordinary skill in the art.

While the invention has been described with reference to a preferred embodiment thereof it will be appreciated by those of ordinary skill in the art that various different modifications may be made to the structure and function of the elements without departing from the spirit and scope of the invention.

I claim:

1. A multi-position leg rest apparatus for use on a wheelchair of the type having a footrest and a footrest frame, said apparatus comprising:

a leg rest cushion having a front edge and a rear edge;

a sliding means slidably attached to said footrest frame;

a first cushion height adjustment means attached to said sliding means for selectively raising the rear edge of said cushion to an elevated position and for lowering the rear edge of said cushion to a storable position; and, a second cushion height adjustment means attached to said sliding means for selectively locating the front edge of said cushion at one of three separate vertical height adjustments corresponding respectively to a lowest first position, an intermediate second position and an upper third position, said second height adjustment means further including:

a first horizontally disposed tubular element rotatably attached to the underside of said cushion;

a second tubular element, vertically oriented with respect to said first tubular element and attached to said first tubular element to form a T-shaped member;

a third tubular element attached to said sliding means and telescopically received within said second tubular element; and, a pushbutton means attached to said second tubular element for engaging said second height adjustment means in at least one of said three positions, wherein the vertical height of the front and rear edge of the leg rest cushion can be independently and selectively adjusted.

2. The apparatus of claim 1 wherein said first cushion height adjustment means comprises:

a transverse, U-shaped member pivotally secured to said sliding means and rotatable with respect thereto;

a plate attached to the bottom underside of said cushion; and, a hook attached to said plate, wherein said transverse, U-shaped member may be engaged by said hook in order to secure the rear edge of said legrest cushion in its elevated, operative position.

3. The apparatus of claim 2 wherein said first cushion height adjustment means further comprises;

a wire frame means attached to said plate and surrounding a portion of such transverse, U-shaped member.

4. The apparatus of claim 3 further including:

stop means attached to said transverse U-shaped member for limiting the rotational stresses placed upon the second and third tubular elements of said second cushion height adjustment means.

5. The apparatus of claim 4 wherein said stop means comprises stop elements which extend downwardly from said transverse U-shaped element and bracket said wire frame means.

6. The apparatus of claim 5 wherein said stop means comprise two rod-like elements.

7. The apparatus of claim 6 wherein said second cushion height adjustment means includes a spring-loaded stop button which locks said second cushion height adjustment means in said third position.

8. The apparatus of claim 7 further including:

a horizontal adjustment means for positioning said leg rest cushion selectively at a plurality of discrete horizontal positions relative to said wheelchair.

* * * * *